US008416149B2

(12) United States Patent
Evanicky

(10) Patent No.: US 8,416,149 B2
(45) Date of Patent: Apr. 9, 2013

(54) ENHANCED VIEWING EXPERIENCE OF A DISPLAY THROUGH LOCALISED DYNAMIC CONTROL OF BACKGROUND LIGHTING LEVEL

(75) Inventor: Daniel E. Evanicky, San Jose, CA (US)

(73) Assignee: Pure Depth Limited, Auckland (NZ)

( * ) Notice: Subject to any disclaimer, the term of this patent is extended or adjusted under 35 U.S.C. 154(b) by 0 days.

(21) Appl. No.: 10/519,285

(22) PCT Filed: Jun. 25, 2003

(86) PCT No.: PCT/NZ03/00132

§ 371 (c)(1),
(2), (4) Date: Oct. 26, 2005

(87) PCT Pub. No.: WO04/002143

PCT Pub. Date: Dec. 31, 2003

(65) Prior Publication Data

US 2006/0125745 A1 Jun. 15, 2006

(30) Foreign Application Priority Data

Jun. 25, 2002 (NZ) ..... 517713

(51) Int. Cl.
*G09G 5/00* (2006.01)

(52) U.S. Cl.
USPC ..... 345/4; 345/6

(58) Field of Classification Search ..... 345/77, 345/87, 102, 4–6
See application file for complete search history.

(56) References Cited

U.S. PATENT DOCUMENTS 3,863,246 A 1/1975 Trcka et al.
3,967,881 A 7/1976 Moriyama et al.
4,294,516 A 10/1981 Brooks
4,333,715 A 6/1982 Brooks
4,364,039 A * 12/1982 Penz ..... 345/4
4,371,870 A 2/1983 Biferno (Continued)

FOREIGN PATENT DOCUMENTS

AU 24806/00 7/2000
AU 24538/00 8/2000

(Continued)

OTHER PUBLICATIONS

"Clearboard 1991-1994," http://web.media.mit.edu/~ishii/CB.html.

(Continued)

*Primary Examiner* — Kevin M Nguyen
*Assistant Examiner* — Cory Almeida

(57) ABSTRACT

A method of controlling brightness, color, hue, color temperature, gamma response or contrast of at least one image for display on a multi-layer display device characterized by carrying out the steps of: receiving said at least one image(s) to be displayed, detecting the brightness, color, hue, color temperature, gamma response or contrast of said image(s) to be displayed, determining the transmissivity of each layer of the multi layer display device in the localized area of said image(s) to achieve the brightness, color, hue, color temperature, gamma response and/or contrast detected or received, communicating the determined transmissivity of each layer of the multi layer display device in the localized area of said image(s) to a display device or storage device. A software device designed to do the same and a display device which can be utilized to controlling brightness, color, hue, color temperature, gamma response or contrast of at least one image.

23 Claims, 3 Drawing Sheets

U.S. PATENT DOCUMENTS

| | | | | |
|---|---|---|---|---|
| 4,472,737 | A | 9/1984 | Iwasaki | |
| 4,485,376 | A | 11/1984 | Noble | |
| 4,523,848 | A | 6/1985 | Gorman et al. | |
| 4,568,928 | A | 2/1986 | Biferno | |
| 4,649,425 | A | 3/1987 | Pund | |
| 4,757,626 | A | 7/1988 | Weinreich | |
| 4,768,300 | A | 9/1988 | Rutili | |
| 4,815,742 | A | 3/1989 | Augustine | |
| 5,050,965 | A | 9/1991 | Conner et al. | |
| 5,075,993 | A | 12/1991 | Weinreich | |
| 5,112,121 | A | 5/1992 | Chang et al. | |
| 5,113,272 | A * | 5/1992 | Reamey | 349/78 |
| 5,124,803 | A | 6/1992 | Troxel | |
| 5,198,936 | A | 3/1993 | Stringfellow | |
| 5,298,892 | A * | 3/1994 | Shapiro et al. | 345/88 |
| 5,300,942 | A * | 4/1994 | Dolgoff | 345/32 |
| 5,302,946 | A | 4/1994 | Shapiro et al. | |
| 5,361,165 | A | 11/1994 | Stringfellow et al. | |
| 5,367,801 | A | 11/1994 | Ahn | |
| 5,369,450 | A | 11/1994 | Haseltine et al. | |
| 5,473,344 | A | 12/1995 | Bacon et al. | |
| 5,515,484 | A | 5/1996 | Sfarti et al. | |
| 5,585,821 | A | 12/1996 | Ishikura et al. | |
| 5,675,755 | A | 10/1997 | Trueblood | |
| 5,694,532 | A | 12/1997 | Carey et al. | |
| 5,695,346 | A | 12/1997 | Sekiguchi et al. | |
| 5,745,197 | A | 4/1998 | Leung et al. | |
| 5,764,317 | A | 6/1998 | Sadovnik et al. | |
| 5,805,163 | A | 9/1998 | Bagnas | |
| 5,825,436 | A | 10/1998 | Knight | |
| 5,924,870 | A | 7/1999 | Brosh et al. | |
| 5,982,417 | A | 11/1999 | Blonde | |
| 5,990,990 | A | 11/1999 | Crabtree | |
| 5,999,191 | A | 12/1999 | Frank et al. | |
| 6,005,654 | A | 12/1999 | Kipfer et al. | |
| 6,054,969 | A | 4/2000 | Haisma | |
| 6,215,490 | B1 | 4/2001 | Kaply | |
| 6,215,538 | B1 * | 4/2001 | Narutaki et al. | 349/106 |
| 6,341,439 | B1 | 1/2002 | Lennerstad | |
| 6,356,281 | B1 | 3/2002 | Isenman | |
| 6,369,830 | B1 | 4/2002 | Brunner et al. | |
| 6,388,648 | B1 * | 5/2002 | Clifton et al. | 345/88 |
| 6,438,515 | B1 | 8/2002 | Crawford et al. | |
| 6,443,579 | B1 | 9/2002 | Myers | |
| 6,525,699 | B1 * | 2/2003 | Suyama et al. | 345/6 |
| 6,538,660 | B1 | 3/2003 | Celi, Jr. et al. | |
| 6,587,118 | B1 | 7/2003 | Yoneda | |
| 6,593,904 | B1 | 7/2003 | Marz et al. | |
| 6,609,799 | B1 | 8/2003 | Myers | |
| 6,661,425 | B1 | 12/2003 | Hiroaki | |
| 6,697,135 | B1 * | 2/2004 | Baek et al. | 349/106 |
| 6,717,728 | B2 | 4/2004 | Putilin | |
| 6,720,961 | B2 | 4/2004 | Tracy | |
| 6,845,578 | B1 | 1/2005 | Lucas | |
| 6,906,762 | B1 * | 6/2005 | Witehira et al. | 349/73 |
| 6,940,507 | B2 | 9/2005 | Repin et al. | |
| 6,958,748 | B1 * | 10/2005 | Fukui et al. | 345/173 |
| 7,113,188 | B2 | 9/2006 | Kuroda et al. | |
| 2002/0001055 | A1 | 1/2002 | Kimura et al. | |
| 2002/0093516 | A1 | 7/2002 | Brunner et al. | |
| 2002/0105516 | A1 | 8/2002 | Tracy | |
| 2002/0126115 | A1 | 9/2002 | Ijntema | |
| 2002/0126396 | A1 | 9/2002 | Dolgoff | |
| 2002/0163728 | A1 | 11/2002 | Myers | |
| 2002/0163729 | A1 | 11/2002 | Myers | |
| 2003/0090455 | A1 * | 5/2003 | Daly | 345/102 |
| 2003/0132895 | A1 | 7/2003 | Berstis | |
| 2003/0184665 | A1 | 10/2003 | Berstis | |
| 2004/0239582 | A1 | 12/2004 | Seymour | |
| 2005/0062897 | A1 | 3/2005 | Lei | |
| 2005/0146787 | A1 | 7/2005 | Lukyanitsa | |
| 2006/0227249 | A1 | 10/2006 | Chen et al. | |

FOREIGN PATENT DOCUMENTS

| | | |
|---|---|---|
| AU | 68219/01 | 12/2001 |
| CA | 2009960 | 9/1990 |
| CA | 2075807 | 8/1991 |
| CN | 1293805 | 5/2001 |
| CN | 1294695 | 5/2001 |
| DE | 2730785 | 1/1979 |
| DE | 29912074 | 11/1999 |
| DE | 19920789 | 5/2000 |
| EP | 0389123 | 9/1990 |
| EP | 454423 | 10/1991 |
| EP | 0460314 | 12/1991 |
| EP | 595387 | 5/1994 |
| EP | 0605945 | 7/1994 |
| EP | 0703563 | 3/1996 |
| EP | 0732669 | 9/1996 |
| EP | 0802684 | 10/1997 |
| EP | 0999088 | 5/2000 |
| EP | 1151430 | 8/2000 |
| EP | 1177527 | 11/2000 |
| EP | 1093008 | 4/2001 |
| EP | 1287401 | 3/2003 |
| FR | 2609941 | 7/1988 |
| GB | 2312584 | 10/1997 |
| GB | 2347003 | 8/2000 |
| GB | 2372618 | 8/2002 |
| IL | 93472 | 11/1994 |
| JP | 61248083 | 11/1986 |
| JP | 63158587 | 7/1988 |
| JP | 3021902 | 1/1991 |
| JP | 3174580 | 7/1991 |
| JP | 3186894 | 8/1991 |
| JP | 3226095 | 10/1991 |
| JP | 3282586 | 12/1991 |
| JP | 4191755 | 7/1992 |
| JP | 4220691 | 8/1992 |
| JP | 4251219 | 9/1992 |
| JP | 5040449 | 2/1993 |
| JP | 6317488 | 11/1994 |
| JP | 8036375 | 2/1996 |
| JP | 8095741 | 4/1996 |
| JP | 09-033858 | 2/1997 |
| JP | 9146751 | 6/1997 |
| JP | 9244057 | 9/1997 |
| JP | 9282357 | 10/1997 |
| JP | 9308769 | 12/1997 |
| JP | 10003355 | 1/1998 |
| JP | 10039821 | 2/1998 |
| JP | 10105829 | 4/1998 |
| JP | 10228347 | 8/1998 |
| JP | 10-334275 | 12/1998 |
| JP | 11205822 | 7/1999 |
| JP | 11272846 | 10/1999 |
| JP | 2000-142173 | 5/2000 |
| JP | 2000-347645 | 12/2000 |
| JP | 2001-100689 | 4/2001 |
| JP | 2000-99237 | 10/2001 |
| JP | 2001324608 | 11/2001 |
| JP | 2002504764 | 2/2002 |
| JP | 2001-215332 | 4/2002 |
| JP | 2002-131775 | 5/2002 |
| JP | 2001-56675 | 9/2002 |
| JP | 2002-350772 | 12/2002 |
| JP | 2002544544 | 12/2002 |
| JP | 2003507774 | 2/2003 |
| JP | 2002-099223 | 10/2003 |
| JP | 2003-316335 | 11/2003 |
| NO | 20005178 | 4/2001 |
| PL | 343229 | 4/2001 |
| WO | 88/05389 | 7/1988 |
| WO | 91/12554 | 8/1991 |
| WO | 98/47106 | 10/1998 |
| WO | 99/42889 | 8/1999 |
| WO | 99/44095 | 9/1999 |
| WO | 00/36578 | 6/2000 |
| WO | 00/48167 | 8/2000 |
| WO | 00/68887 | 11/2000 |
| WO | 01/01290 | 1/2001 |
| WO | 01/15127 | 3/2001 |
| WO | 01/15128 | 3/2001 |
| WO | 0157799 | 8/2001 |
| WO | 01/95019 | 12/2001 |
| WO | 02/35277 | 5/2002 |

| | | |
|---|---|---|
| WO | 02/084637 | 10/2002 |
| WO | 02/091033 | 11/2002 |
| WO | 03/003109 | 1/2003 |
| WO | 03032058 | 4/2003 |
| WO | 2004001488 | 12/2003 |
| WO | 2004102520 | 11/2004 |
| ZA | 9703025 | 11/1997 |

OTHER PUBLICATIONS

"Teamworkstation 1989-1994," http://web.media.mit.edu/~ishii/TWS.html.
"Textarc: An Alternate Way to View a Text," http://textarc.org.
"Textarc: NYSCA Grant and Public Installation," http//textarc.org.
"Textarc: The Print and the Artist," http://textarc.org.
Courter et al., Microsoft Office 2000 Professional Edition, 1999, Sybex Inc., pp. xxxi, 543, 685.
Harrison et al., "Transparent Layered User Interfaces: An Evaluation of a Display Design to Enhance Focused and Divided Attention" ACM, 13 pages, 1995.
Ishii et al., "Iterative Design of Seamless Collaboration Media", Communications of the ACM, Aug. 1994, vol. 37, pp. 83-97.
Office Action U.S. Appl. No. 10/489,101 Mar. 29, 2006.
Office Action U.S. Appl. No. 10/489,101 Jul. 16, 2007.
Office Action U.S. Appl. No. 10/489,101 Jul. 28, 2005.
Office Action U.S. Appl. No. 10/489,101 Nov. 22, 2005.
Office Action U.S. Appl. No. 10/841,133 Jan. 8, 2007.
Office Action U.S. Appl. No. 10/841,133 Sep. 6, 2007.
Office Action U.S. Appl. No. 10/841,133 Nov. 28, 2007.
Final OA Dated Feb. 24, 2009; U.S. Appl. No. 10/528,334.
Office Action U.S. Appl. No. 10/528,334; Mail Date Feb. 24, 2009.
Office Action U.S. Appl. No. 10/528,334; Mail Date Aug. 5, 2008.
Office Action U.S. Appl. No. 10/841,133; Mail Date Aug. 7, 2008.
Non-Final Office Action Dated Aug. 12, 2009; U.S. Appl. No. 12/107,589.
Non-Final Office Action Dated Sep. 9, 2009; U.S. Appl. No. 10/557,157.
Non-Final Office Action Dated Sep. 1, 2009; U.S. Appl. No. 10/528,334.
"Display", http://web.archive.org/web/20010717132509/http://whatis.techtarget.com/definition/0,,sid9__gci211965,00.html, Jul. 27, 2000.
Non-Final Office Action Dated Feb. 16, 2010; U.S. Appl. No. 12/107,589.
Non-Final Office Action Dated Jan. 11, 2010; U.S. Appl. No. 10/519,285.
Final Office Action Dated Apr. 15, 2010; U.S. Appl. No. 10/557,157.
Non-Final Office Action Dated May 14, 2010; U.S. Appl. No. 11/804,650.
Final Office Action Dated Jun. 25, 2010; U.S. Appl. No. 12/107,589.
Final Office Action Mailed Oct. 27, 2010; U.S. Appl. No. 11/804,650.
Office Action Dated Sep. 4, 2012, U.S. Appl. No. 12/778,039.
Office Action Dated Mar. 26, 2012, U.S. Appl. No. 12/089,390.
Office Action Dated Mar. 27, 2012, U.S. Appl. No. 12/778,039.
Office Action Dated Aug. 17, 2012, U.S. Appl. No. 12/813,173.
Office Action Dated Aug. 24, 2012, U.S. Appl. No. 11/804,650.
Notice of Allowance Dated Sep. 14, 2012, U.S. Appl. No. 12/089,390.
Notice of Allowance Dated Nov. 23, 2012, U.S. Appl. No. 10/528,334.
Notice of Allowance Dated Dec. 9, 2012, U.S. Appl. No. 10/557,157.
Final Office Action; U.S. Appl. No. 12/831,173; Dated Dec. 27, 2012.

* cited by examiner

ENHANCED VIEWING EXPERIENCE OF A DISPLAY THROUGH LOCALISED DYNAMIC CONTROL OF BACKGROUND LIGHTING LEVEL

TECHNICAL FIELD

This invention describes a method to enhance the viewing experience of a flat panel display of any video or still imagery through the localized dynamic control of the background lighting level of a specific area or areas of a scene or succession of video frames. This can be accomplished using a unique arrangement of two stacked flat panel displays, one of which would control backlight brightness values synchronized to appropriate areas within the scenes or images of the visual content being presented on the other display. This control could be provided over the video signal cable (DDC), serial, USB or a customized type of interface protocol.

BACKGROUND ART

Multi-layered display (MLD) units provide a significant improvement over existing single layer display (SLD) units or displays. MLD units may be used to nest display content over spacially displaced or stacked layers to provide an enhanced mechanism for information absorption and analysis by users. An example of an existing multi-layer display is discussed for example in WO9942889A.

Reference throughout this specification will also be made to the present invention being used in conjunction with multi-layer displays of the type disclosed in WO9942889A. However, those skilled in the art should appreciate that the present invention may also be adapted for use with other types of MLD units and reference to the above only throughout this specification should in no way be seen as limiting.

The frequency spectrum of radiation incident upon a detector depends on the properties of the light source, the transmission medium and possibly the properties of the reflecting medium. If one considers the eye as a detector the human visual system can sense radiation that has a wavelength between 700 nm and 380 nm. Hence this is described as the visual part of the electromagnetic spectrum. Humans perceive certain frequency distributions as having different colours and brightness. A scheme was devised to describe any perceived colour and brightness via adding three basis spectral distributions with various weights. For example in the 1931 CIE colour space any perceivable colour may be described by the following equation:

$$C=x_rX+y_rY+z_rZ$$

Where C is the colour being described, Xr, Yr and Zr are the weights and X, Y and Z are 1931 CIE tristimulis curves which are graphs of the relative sensitivity of the eye Vs wavelength. For any given colour, the weights may be determined by the following equations:

$$x_r=\int C(\lambda)X(\lambda)d(\lambda)$$

$$y_r=\int C(\lambda)Y(\lambda)d(\lambda)$$

$$z_r=\int C(\lambda)Z(\lambda)d(\lambda)$$

The 1931 co-ordinates are formed via the following normalisation:

$$x_r = \frac{X_r}{X_r + Y_r + Z_r}$$

$$y_r = \frac{Y_r}{X_r + Y_r + Z_r}$$

$$z_r = 1 - x_r - y_r$$

These may be plotted on the 1931 CIE diagram. The spectral locus defines the pure spectral colours, that is the perception of radiation with a specific wavelength. Colour co-ordinates that are closer or farther from pure spectral colours are described as being more or less saturated respectively. The value of the y coordinate is also referred to as the luminance or the variable L.

Pixels on a transmissive display, that is a display that channels light from a rear mounted source, will be capable of maximum and minimum luminous states. If one labels the maximum state as Lb and the minimum as Ld then the contrast ratio is described by $$C_r = \frac{L_b}{L_d}$$

The perception model described above accurately predicts that colours on displays can be formed by mixing small areas of three basis colours with modulated intensities which are close in either spatial or temporal proximity. If the basis colours are plotted on the CIE diagram then the enclosed triangle contains all the colours producible by the system. The enclosed area is called the colour gamut and hence a display with a larger area can display a greater variation in colour and has a greater colour gamut.

There are two main types of Liquid Crystal Displays used in computer monitors, passive matrix and active matrix. Passive-matrix Liquid Crystal Displays use a simple grid addressing system to supply the charge to a particular pixel on the display. Creating the grid starts with two glass layers called substrates. One substrate is given columns and the other is given rows made from a transparent conductive material. This is usually indium tin oxide. The rows or columns are connected to integrated circuits that control when a charge is sent down a particular column or row. The liquid crystal material is sandwiched between the two glass substrates, and a polarizing film is added to the outer side of each substrate.

A pixel is defined as the smallest resolvable area of an image, either on a screen or stored in memory. Each pixel in a monochrome image has its own brightness, from 0 for black to the maximum value (e.g. 255 for an eight-bit pixel) for white. In a colour image, each pixel has its own brightness and colour, usually represented as a triple of red, green and blue intensities. To turn on a pixel, the integrated circuit sends a charge down the correct column of one substrate and a ground activated on the correct row of the other. The row and column intersect at the designated pixel and that delivers the voltage to untwist the liquid crystals at that pixel.

The passive matrix system has significant drawbacks, notably slow response time and imprecise voltage control. Response time refers to the Liquid Crystal Displays ability to refresh the image displayed. Imprecise voltage control hinders the passive matrix's ability to influence only one pixel at a time. When voltage is applied to untwist one pixel, the pixels around it also partially untwist, which makes images appear fuzzy and lacking in contrast.

Active-matrix Liquid Crystal Displays depend on thin film transistors (TFT). Thin film transistors are tiny switching transistors and capacitors. They are arranged in a matrix on a glass substrate. To address a particular pixel, the proper row is switched on, and then a charge is sent down the correct column. Since all of the other rows that the column intersects are turned off, only the capacitor at the designated pixel receives a charge. The capacitor is able to hold the charge until the next refresh cycle. And if the amount of voltage supplied to the crystal is carefully controlled, it can be made to untwist only enough to allow some light through. By doing this in very exact, very small increments, Liquid Crystal Displays can create a grey scale. Most displays today offer 256 levels of brightness per pixel.

A Liquid Crystal Display that can show colours must have three subpixels with red, green and blue colour filters to create each colour pixel. Through the careful control and variation of the voltage applied, the intensity of each subpixel can range over 256 shades. Combining the subpixel produces a possible palette of 16.8 million colours (256 shades of red×256 shades of green×256 shades of blue).

Liquid Crystal Displays employ several variations of liquid crystal technology, including super twisted nematics, dual scan twisted nematics, ferroelectric liquid crystal and surface stabilized ferroelectric liquid crystal. They can be lit using ambient light in which case they are termed as reflective, or backlit and termed Transmissive. There are also emissive technologies such as Organic Light Emitting Diodes, which are addressed in the same manner as Liquid Crystal Displays. These devices are described hereafter as image planes.

Another subset of LCDs, known as "transflective" or partially reflective displays, is important to consider. In this application, a portion of the rear part of the liquid crystal subpixel cell (either internally or externally) is coated with a light reflecting material. The coverage achieved by this reflector material may comprise from 20% to 30% or more of the total active (light transmitting) area of a given subpixel. Any incident light on this part of the cell coming from a rear-mounted backlight would not be able to reach the viewer's eye unless it were diffused and re-reflected in another spot. However, the equivalent portion of ambient light from overhead fluorescent lighting or even the sun would pass through the cell's colour filter and liquid crystal layer to be reflected (after appropriate greyscale modification) back to the user. This system allows portable colour (or even monochromatic) displays such as Tablet PCs, PDAs, and even cell phones to be easily readable even in the harshest of ambient lighting environments without requiring the energy drain on a battery produced by an emissive backlight.

Common to the display marketplace are "emissive" displays such as CRTs where the luminance of a characteristic colour, shade and brightness is derived from electronically excited photon emission at the subpixel site itself. There are other emissive display technologies which are consistent with this description such as those based on Organic Light Emitting Diodes (OLEDs), Electroluminesce (EL), and plasma. Each of these technologies can be used in conjunction with an overlying transmissive (or even transflective) liquid crystal display to achieve a Multi-Layer configuration.

No known reproduction process can exactly capture the original elements in a given situation (e.g. the brightness of the sun shining down on a landscape). All colour reproduction systems can hope to do is replicate the relative differences between objects in the original view. The ratio of the whitest point to the blackest point in a scene is know as its dynamic range, which must be reproduced on some medium such as film, a CRT, an LCD, or paper. The characteristics of this medium, or its "native response," will determine the level of success a given reproduction achieves. The number of steps, or grayscale, into which this dynamic range can be subdivided determines the resolution of a particular primary colour. A typical monitor system will have the ability to display 8-bits, or 256 shades per primary colour for a total of over 16.7 million colours (256×256×256). This is known as the colour depth or image palette of the display system.

All display mediums, especially CRTs, introduce some amount of distortion, which has to be corrected to make the reproduced image look "proper." The human eye sees logarithmically. To compensate for this, playback or image reproduction media must mimic the human visual response curve so that the display shows information in a way we are used to seeing. The resulting response curve varies in an exponential manner known as the "gamma curve" which is a polynomial equation describing any point on a curve native to a particular monitor. In a typical imaging system, the brightness changes very little at the lower energy grey levels causing some compression of the shadow detail where our eyes are the most sensitive. So instead of a straight-line, linear response where there is an equal amount of output for every value of input, the curve has a long, shallow beginning before it begins to climb.

Video or static images or scenes that are created, edited, stored, and then presented on flat panel media which displays them according to the luminance or brightness values which the author or editor imparts to them. Once they are imprinted and/or duplicated, further changes to the luminance properties of the content being displayed are only possible if applied to ALL the content. Until now, no method has been devised for controlling individual portions of a given scene, frame, or series of frames in a prescribed, dynamic fashion. Such a device or method would be useful.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to go at least some way towards addressing the foregoing problems or to at least provide the public with a useful choice.

Further aspects and advantages of the present invention will become apparent from the ensuing description which is given by way of example only.

DISCLOSURE OF INVENTION

The processes and tools described here are intended to describe the implementation of a visual imaging system capable of offering an enhanced video viewing experience when used with a multi-layer display arrangement. It accomplishes this by employing hardware and software techniques to adjust the parameters of the components of a portion or portions of the image on one display such as the gamma response, contrast ratio, colour temperature, and brightness—frame by frame—by varying the complementary parameters of the selected portion or portions of the frame being displayed on the other (under- or over-lying) image plane. A software utility can be designed so as to capture a frame of video information and calculate the values of the aforementioned parameters and adjust them accordingly through the use of special algorithms which then pass that value or values to a software lookup table (LUT) adjustable by the viewer wishing to create an enhanced or modified visual experience of the content being viewed. The values will be accepted by custom hardware and software driven devices which will then translate the commands into the subpixel chromaticity and brightness settings on one display that are required to modify the image being displayed on the other display. The controller device, with suitable switching adjustments, will be able to control the desired areas of either component of a multi-layer display stack.

Accordingly in a first aspect of the invention may broadly said to consist in an image appearance controller for controlling brightness, colour, hue, colour temperature, gamma response or contrast of at least one image for display on a multi layer display device comprising:

i) a receiving means for receiving said at least one image(s) to be displayed;

ii) a detecting means for detecting the brightness, colour, hue, colour temperature, gamma response or contrast of said image(s) to be displayed, iii) a determining means for determining the transmissivity of each layer of the multi layer display device in the localised area of said image(s) to achieve the brightness, colour, hue, colour temperature, gamma response and/or contrast detected or received, iv) a communicating for communicating the determined transmissivity of each layer of the multi layer display device in the localised area of said (images) to a display device or storage device.

A further aspect of the current invention may broadly said to consist in an image appearance control system for controlling brightness, colour, hue, colour temperature, gamma response or contrast of at least one image for display on a multi layer display device carrying out the steps of:

i) receiving said at least one image(s) to be displayed;

ii) detecting the brightness, colour, hue, colour temperature, gamma response or contrast of said image(s) to be displayed, iii) determining the transmissivity of each layer of the multi layer display device in the localised area of said image(s) to achieve the brightness, colour, hue, colour temperature, gamma response and/or contrast detected or received, iv) communicating the determined transmissivity of each layer of the multi layer display device in the localised area of said (images) to a display device or storage device.

As such the current invention is a method to or apparatus designed to control and enhance the brightness, colour, hue, colour temperature, gamma response or contrast of at least one image to be displayed on a multi layer display device by controlling the transmissivity of the layers of said multi layered device in the localised area of said image(s).

The term 'transmissivity' as used herein should be interpreted as meaning the degree of transmission of light through a transmissive layer or item. In particular the transmissivity should be interpreted as the transmission in terms of colour or chromaticity and brightness of light passing through that layer or item.

The term 'image' as used herein should be interpreted as meaning any type of image for example (without limitation) any content, display element, image, scene, ranging from static to video images or any part there-of.

Preferably the receiving means or the step or receiving the image(s) is adapted to receive full scenes and video images.

Preferably the receiving means or the step of receiving the image(s) is able to receive the brightness and colour of each pixel of the image(s).

Preferably the detecting means or the step of detecting brightness, colour, hue, colour temperature, gamma response and/or contrast step detects the overall brightness, colour, hue, colour temperature, gamma response and/or contrast of the image(s) to be display and preferably it is implemented for example by means of software or hardware which is controlled by a user who interacts with it to define the level of contrast, brightness and/or colour of said image(s) desired. Alternatively the brightness, colour, hue, colour temperature, gamma response and/or contrast may be determined by a software application.

Preferably the determining means or the step of determining calculates the transmissivity of each pixel of the image on each layer by reference to the brightness and colour of each pixel of the image, the brightness, colour, hue, colour temperature, gamma response and/or contrast to be determined and then by reference to a pre-defined algorithm or look-up table or alternatively an algorithm or look up table which can be adjusted by the user or software developer the transmissivity of each pixel on each layer of the multi layer display is determined. Typically this will involve one layer displaying the image received and a second layer controlling the brightness, colour, hue, colour temperature, gamma response and/or contrast.

Preferably the determining means or the step of determining throughout this specification is definable by a user/content developer to allow customisation to allow the particular gamma response of each layer of the intended multi layer display device or alternatively any preferred gamma curve to be factored in which calculating the transmissivity of each layer of the multi layer display device in the localised area of each image.

Preferably the image appearance control system or image appearance controller is attached to a multi layer display device upon which, by utilising appearance control system or image appearance controller, images can be displayed with enhanced or controlled brightness, colour, hue, colour temperature, gamma response and/or contrast of said image(s).

Preferably the means of communication or communicating step can communicate with individual display layers of multi layer display device or alternatively can communicate with a recording or storage device such as a CPU that is able to record or store the level of transmissivity of each display layer for subsequent retrieval and display of images with enhanced or controlled contrast.

Accordingly in a first aspect of the invention may broadly said to consist in a brightness, colour, hue, colour temperature, gamma response or contrast controller for controlling brightness, colour, hue, colour temperature, gamma response or contrast of at least one image for display on a multi layer display device comprising:

i) a receiving means for receiving said at least one image(s) to be displayed;

ii) a detecting means for detecting the brightness, colour, hue, colour temperature, gamma response or contrast of said image(s) to be displayed, iii) a determining means for determining the transmissivity of each of the non-display layers of the multi layer display device in the localised area of said image(s) to achieve the brightness, colour, hue, colour temperature, gamma response and/or contrast detected or received, iv) a communicating for communicating the determined transmissivity of the non-display layers of the multi layer display device in the localised area of said (images) to a display device or storage device.

A further aspect of the current invention may broadly said to consist in a brightness, colour, hue, colour temperature, gamma response or contrast control system for controlling brightness, colour, hue, colour temperature, gamma response or contrast of at least one image for display on a multi layer display device carrying out the steps of:

i) receiving said at least one image(s) to be displayed;

ii) detecting the brightness, colour, hue, colour temperature, gamma response or contrast of said image(s) to be displayed, iii) determining the transmissivity of each of the non-display layers of the multi layer display device in the localised area of said image(s) to achieve the brightness, colour, hue, colour temperature, gamma response and/or contrast detected or received, iv) communicating the determined transmissivity of each of the non-display layers layer of the multi layer display device in the localised area of said (images) to a display device or storage device.

The term 'non-display layers' as used herein should be interpreted as the layers capable of controlling brightness, colour, hue, colour temperature, gamma response or contrast on which the image as originally received is not displayed. So in a two layered multi layer display consisting of two LCDs which are backlit, one layer would be a display layer on which images are displayed and the other layer would be a 'non display layer' with which brightness, colour, hue, colour temperature, gamma response and/or contrast of images is controlled.

As such the invention is a method of controlling brightness, colour, hue, colour temperature, gamma response or contrast of an image which is to be displayed on a display as received, unaltered. So the image(s) received can be displayed without altering the transmissivity of the layer on which it is (they are) to be displayed and their appearance (brightness, colour, hue, colour temperature, gamma response or contrast) can be controlled and enhanced through the control of transmissivity of the other layers in the localised area of said image(s).

Accordingly in another aspect of the current invent can broadly be said to consist in an image appearance controller or an image appearance control system which controls at least two of the following attributes of an image (or images) in combination utilising the methods or steps described here-in: brightness, colour, hue, colour temperature, gamma response or contrast.

As such the current invention is a method to or apparatus designed to control the controlling brightness, colour, hue, colour temperature, gamma response or contrast in combination, of at least one image to be displayed on a multi layer display device by controlling the transmissivity of the layers of said multi layered device in the localised area of said image(s).

Preferably the means of detecting means or step of detecting is able to detect information as to brightness, colour, hue, colour temperature, gamma response or contrast of an image or image(s) in combination.

Preferably the current invention is embodied in software or hardware whereby the user or content developer defines brightness, colour, hue, colour temperature, gamma response or contrast of each image he or she desires to display which is detected by the means of detecting or the detecting step, the determining step or means of determining calculates the localised transmissivity of each layer of the multi layer display for each image and the communicating step or means of communicating stores communicates that information for storage or display on an multi layer display system.

Accordingly in another aspect of the current invention can broadly be said to consist in an image appearance controller or an image appearance control system for use with a multi layer display device utilising the methods or apparatus of controlling the contrast of an image or images as described here-in while brightness of said image(s) is maintained utilising the methods or apparatus described here-in such that net brightness perceived of the image(s) is maintained despite any change to contrast.

As such the current invention is a method to alter contrast of an image or images without giving the viewer the perception of any change in brightness. That is, while a change in contrast of an image or image(s) at the detecting step or the means of detecting causes the determining means to increase or reduce overall brightness (depending on the contrast change) of said image(s), the determining means would additionally determine the transmissivity of each layer of the multi layer display in the localised are of images so controlled in order that the overall brightness of said images would be maintained.

Preferably the determining step or the means of determining will determine or calculate the transmissivity of brightness to remain the same despite any adjustment to or control of contrast. In this manner the user is able to define the contrast of an image or images without having to additionally adjust the brightness of such image(s). The automatic control of the brightness is performed using the methods or apparatus of controlling brightness as described here-in.

Equally a contrast can be maintained despite any change in brightness of an image.

Preferably the determining means or the step if determining can determine the transmissivity of each layer independently, such that the transmissivity determined of each layer in the localised area of the image(s) to be subsequently displayed can be different, or independently determined.

According to a further aspect of the current invention, a device is implemented to carry out the methods of controlling brightness, colour, hue, colour temperature, gamma response or contrast utilising the methods set out here-in.

Preferably the embodiment of the invention comprises a software which carries out the step of receiving or detecting the desired or specified brightness, colour, hue, colour temperature, gamma response or contrast of the image to be displayed and on this basis the determining means or the step of determining, determines the transmissivity of each layer of the MLD.

This device is further described in the best modes of carrying out the invention below.

Accordingly in a further aspect of the invention may broadly said to consist in a display with enhanced image control comprising:

i) at least one display device which is (are) at least in part selectively transparent upon which at least one image is displayed;

ii) and a backlighting system which illuminates said image(s);

iii) and at least one transmissivity control device that selectively controls the transmission of light from said backlight to the viewer in the localised area of said image(s).

The term 'backlight system' as used herein should be interpreted as meaning any type of system which illuminates a display device at least in part from behind that display device by any means including for example (but without limitation) phosphorous tubes as seen in typical Liquid Crystal Display arrangements. For the avoidance of doubt, the source of the light need not be or need not solely be behind the display.

In a preferred embodiment of the current invention the at least one display device in the current invention is a (are) Liquid Crystal Display panel(s).

In a preferred embodiment of the current invention the at least one transmissivity control device in the current invention is a (are) Liquid Crystal Display panel(s).

Accordingly a further aspect of the present invention consists is a display comprising of:

i) at least one display device which emanates its own light upon which at least one image is displayed; and ii) at least one transmissivity control device that selectively controls the transmission of light from said display device to the viewer in the localised area of said image(s).

A display comprising of:

i) at least one display device which is a transflective display device, upon which at least one image is displayed;

ii) at least one transmissivity control device that selectively controls the transmission of light from said display device to the viewer in the localised area of said image(s).

Preferably the at least one display device is adapted to display video images and preferably it is adapted to be attached to a CPU or other device from which it can receive images to be displayed such as a DVD player. Preferably the at least one display device may be driven through software code of computer based instructions loaded into a programmable logic device such as a computer or a microprocessor.

Preferably the at least one transmissivity control device it is adapted to be attached to a CPU or other device from which it can receive transmission levels such as a DVD player. Preferably the at least one transmissivity control device may be driven through software code of computer based instructions loaded into a programmable logic device such as a computer or a microprocessor.

Preferably the at least one transmissivity control device and the at least one display device same device are adapted to be driven or controlled by the same device.

Preferably the at least one transmissivity control device is adapted to selectively control the transmission of light on the basis of user or software defined preferences associated with the image to be displayed on the display device. For example a user, content developer or publisher may define the level of transmission of light associated with a particular image.

Preferably the at least one transmissivity control device is adapted to control the transmission of light specific to the shape of the image or images being displayed.

Preferably the at least one transmissivity control device and the at least one display device display are adapted to be driven in conjunction so that the transmissivity control device controls the transmission of light associated with the image(s) on the display device.

Adding the extra dimension of control imparted by a second display vertically stacked behind the panel displaying the video content allows this brightness adjustment to occur in a localized area or areas rather than being applied to the entire scene in a given frame. Appropriate and selective blockage of the backlight luminance level can be accomplished by applying variously darker neutral grey levels (at 50% transmission, for instance) to the pixels of the second display directly behind the portions of the scene one might wish to be de-emphasized or occluded. Conversely, the pixels behind areas of the image one wishes to be made brighter can be driven at grey levels corresponding to full or 100% transmission so as to allow all the backlight power to illuminate those areas.

The control of colour or "chromaticity" for example allows the image to be saturated (or less saturated as the case may be) with colour.

In addition to brightness levels, recorded levels for image attributes such as hue, saturation, and colour temperature may also be present.

Regardless of the type of display device utilised as described here-in, the display is capable of controlling the brightness, colour, hue, colour temperature, gamma response or contrast of an image or images by way of the transmissivity control device selectively controlling the brightness, colour, hue, colour temperature and/or contrast of said image(s) to be displayed in the localised area.

The visual digital media applications that could be enhanced with this method include DV, HDTV, eCinema, DVD, QuickTime, AVI, RealVideo, etc; vector animation such as Flash; presentation software such as PowerPoint, slide-show software etc; tagged static image file formats such as JPEG or GIF images in web pages, PhotoCD, TIFF, PhotoShop, etc. Enhancements to the viewing experience described herein will be particularly valuable to the entertainment and publishing industries.

Methods are possible to one skilled in the art whereby the brightness of the display can be synchronized to the static or video image content being displayed on a flat panel device. Software can be written to examine the grey scale content of a frame or a series of frames to compute, for instance, an arithmetic mean of the changing (dynamic) brightness level. Depending on present values from a given group of parameters, the software can cause instructions to be transmitted through a suitable application programming interface (API) to a backlight driver to dynamically adjust the brightness level of the display by controlling the voltage levels of lamp or lamps illuminating the display.

Accordingly, in a further aspect of the invention may broadly said to consist in an enhanced method of controlling transmissivity of light in the localised area of image(s) where the at least one transmissivity control device and the transmissivity of the at least one display device being controlled in conjunction to maintain the same or a similar level of luminance of said image(s) as would be experienced by the viewer when no transmissivity control device is present or was present but was not acting to block or filter light.

In the first case where the backlight luminance is partially blocked, the gamma response curve of the pixels of the corresponding area on the display showing the video content may now be altered so as to increase their transmissivity. This increase, while not altering the net brightness level reaching the observer, will allow for an increased level of actinic stimulus of his visual cortex. Hence, by synchronously lowering the backlight brightness level through the use of a transmissivity control device and decreasing the gamma value of an image so that the same resultant luminance level is maintained, a more vibrant colour impact can be achieved than before possible with non-dynamic playback.

Preferably the current invention is adapted such that the net luminance level is maintained or approximately maintained such that the viewer's viewing experience is enhanced through improved contrast by limiting the transmission of light to the display device through the use of the transmissivity control device while at the same time increasing the transmissivity of the display device.

The present invention may provide many potential advantages over the prior art.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
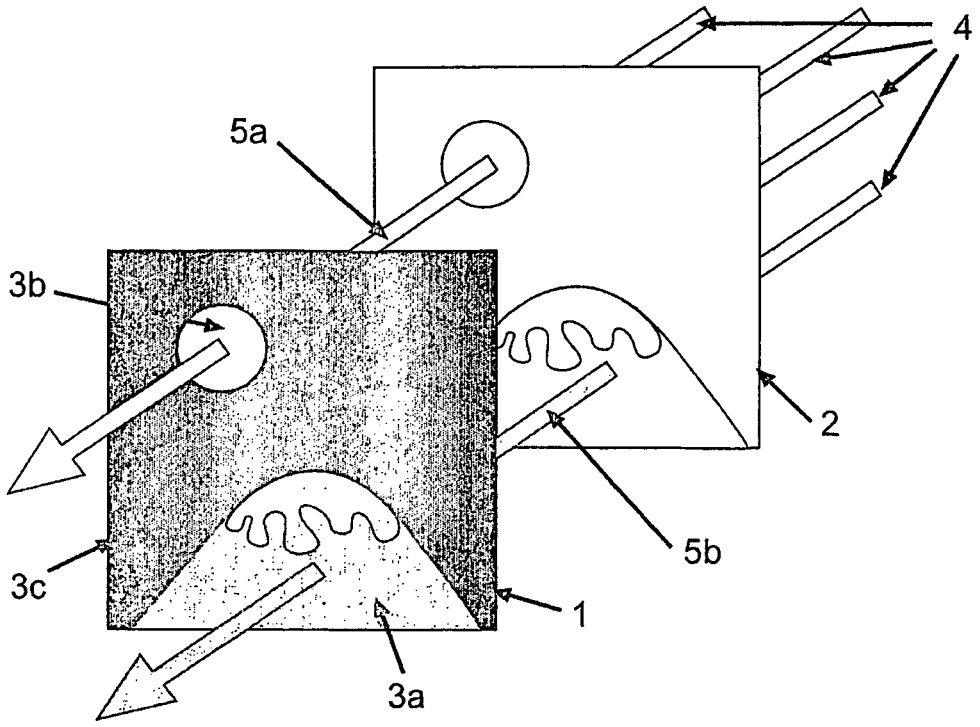
FIG. 1 illustrates a diagram of the display device and transmissivity control device used in conjunction to display a scene with improved colour and contrast characteristics.

FIG. 1 illustrates a diagram of the display device and transmissivity control device used in conjunction to display a scene with improved colour and contrast characteristics.

In the instance shown, a transparent LCD layer or panel acting as a display device (1) and a further transparent LCD layer or panel acting as an transmissivity control device (2) are arranged and displaced in a line with respect to one another, however, in use, the display device and transmissivity control device are aligned directly in front of the next to form a stacked or sandwiched construction. The scene to be displayed consists of a hilltop, the moon, and the nights sky (3*a, b* and *c*), which are displayed upon the display device. Light enters from a backlighting system (not illustrated) behind the transmissivity control device (4). The transmissivity control device controls this light, selectively in the localised area of the images. As such the resultant light exiting the transmissivity control device in the case of the moon (5*a*) is bright and saturated in yellow colour (colour not illustrated), and in the case of the hilltop the resultant light less intense and less saturated in colour (5*b*). Light entering the transmissivity control device in the localised area of the night's sky is blocked to the greatest degree possible (if not completely) by both the transmissivity control device and the display device. The resultant image displayed on the display device has increased contrast ratio particularly between the moon and the night's sky and additionally the colour of the images is more vibrant.

In the preferred embodiment illustrated the display comprises two LCDs which are stacked in construction. Those LCDs are preferably colour LCDs, although alternatively it is less expensive to use a grey-scale LCDs. In particular a grey-scale LCD acting as an transmissivity control device can be used in combination with a colour LCD acting as a display device. This colour LCD/grey-scale LCD combination or multiple grey-scale LCD combination will effectively control illumination of the images but will add little to the colour enhancement attributes described in the current invention and as such contrast ration is effectively controlled but not colour saturation or other colour characteristics.

In this preferred embodiment of two layered LCDs moiré interference may result due to the layering of like patterns and this may be overcome or limited through the use of a light diffusing device such as an random homogenous layer placed between the LCDs and such interstitial layers need to be factored in which determining the transmissivity of layers of the multi layer display device.

Alternatively the LCD in front (from the viewer's perspective) is used as the illumination controlling device and the LCD in the rear is used as the display device.

Preferably the LCD layers are constructed so that there is as little distance as possible between the two layers.

In this preferred embodiment of two stacked LCD layers can be used in their normal way as addressable image display devices and can be attached to a CPU or other device driver. As such the many software applications for content production and editing can be used in conjunction with the present invention.

In this preferred embodiment of two stacked LCD layers the rear layer can be used as both for the purpose contrast and colour enhancement as described in this invention and also if those layers are displaced by distance the embodiment can be used for the purpose independent image display such that different images can be displayed on the front and rear layers with depth enhanced perception.

In a further preferred embodiment, the enhancement of contrast ratio and colour takes place on the basis of user interaction. This user interaction embodiment involves attaching the display to a CPU or other device driver such that the user can determine the level of illumination control he or she requires to enhance the images displayed on the display device—in terms of brightness, contrast, hue, colour temperature and of colour. The user is able to interact with a software application, specifying the brightness and colour he or she wishes to be perceived when the image is viewed and the software application drives both the transmissivity control device and the display layer to display an image with those specified characteristics. He or she may preferably control the gamma curve of each layer utilised in calculating transmissivity of that layer. Preferably the level of illumination and colour control the transmissivity control device exhibits is controlled by a sliding scale controlled for example by a mouse of key-strokes with which the user interacts. Alternatively the device with which the user interacts can be hard-wired and the user interacts with physical sliders or knobs.

Utilising this preferred embodiment of user interaction, colour and contrast enhanced images or indeed entire movies could be pre-recorded for playback using a CPU or other device driver such as a DVD. The viewer of this preferred embodiment would largely be unaware of the mechanisms controlling such enhancement of colour and contrast but would enjoy an improved viewing experience.

Figure 2:
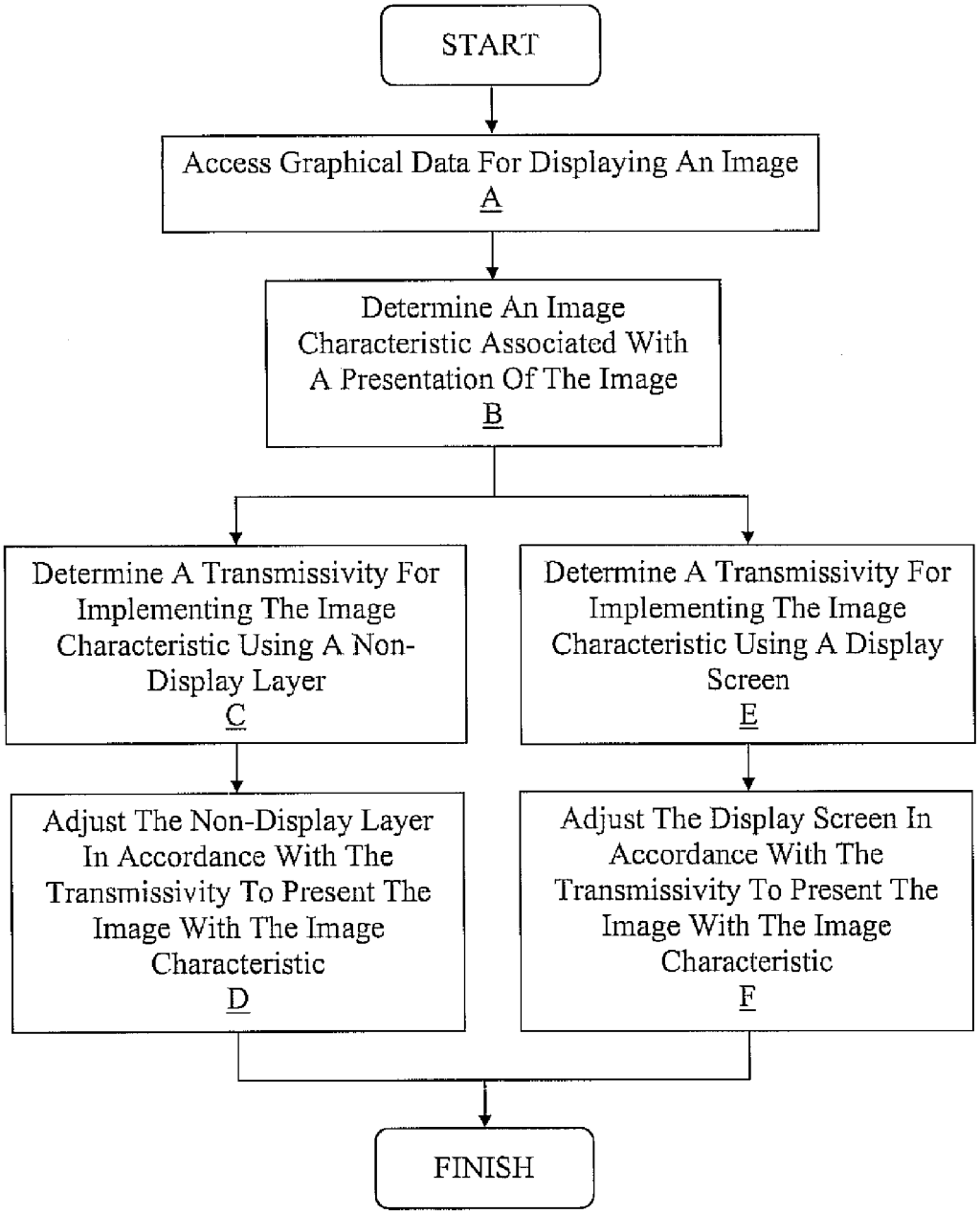
FIG. 2 illustrates a flowchart diagram of information flows and steps executed by software to display images with improved colour and contrast characteristics.

FIG. 2 illustrates a flowchart diagram of information flows and steps executed by software to display images with improved colour and contrast characteristics. In FIG. 2 execution starts a block A which is the step of an image file being present in an addressable format (preferably Red Green Blue format). The flowchart proceeds to block B which is the processing stage. Processing of an image is undertaken either on the basis of user defined preferences or on the basis of pre-defined settings whereby the contrast or illumination and the colour or chromaticity is defined. The processing stage then presents two pieces of information from one of which is the information required to drive the transmissivity control device (C) for display on the transmissivity control device (D). The other information presented by the processing stage is the information required to drive the display device (E) which is displayed on the display device (F). Obviously the combination of the user controlled contrast ratio and colour enhancement embodiment with the two stacked LCD layers embodiment would allow the user/content developer to precisely control the viewing characteristics of the image to be displayed.

Figure 3:
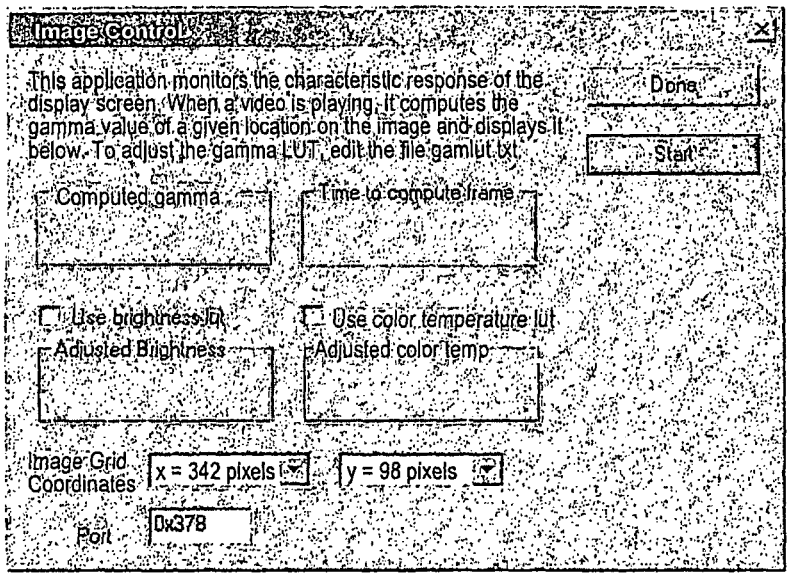
FIG. 3 illustrates a sample image control software panel associated with a preferred embodiment.

FIG. 3 illustrates a sample image control software panel associated with a preferred embodiment where there is an is an application that reads the display screen, calculates a value, optionally corrects it, outputs the value to an appropriate information transferral port, and optionally corrects the display gamma.

The calculated value is the average grey level of the subpixels in the area intended to be changed or modified. Gray is calculated using:

grey=red*0.3+green*0.59+blue*0.11

The calculation is performed according to a timer which can be initiated, for instance, every 100 milliseconds. However, if the calculation takes longer than 100 milliseconds then the calculation is done less frequently. The time for each frame calculation is displayed in the "Time to compute frame" readout in the sample control panel figure (FIG. 3).

For instance, as a default setting, the application could be set to read every eighth pixel, horizontally and vertically. That is, one out of every 8×8 or 64 pixels is used to compute the grey value for the gamma determination. This can be adjusted using the Skip Pixels option. There are settings for 1, 2, 4, 8, and 16 pixels. When set to 1, every pixel on the screen is read.

The calculated gamma response, for instance, can be affected by a lookup table. This is a table of, say, 256 floating point values, normally in the range 1.0 to about 2.3, that can adjust the brightness of each subpixel or groupie of subpixels in a single area or multiple areas in response to a measured value. The table can be edited by changing the text file named "gamlut.txt" which could be located in the same directory as the application. If "Use gamma lut" is checked in the application (as illustrated), then the adjusted brightness is run through the gamma lut table to produce a floating point value which is output to the device gamma table. For example if the adjusted brightness is 125 and a certain gridpoint location, and the gamma lut contains the value 1.5 at location 125, then a gamma 1.5 table is computed and the windows display device is updated. Unchecking "Use gamma lut" in the application (as illustrated) would set a gamma of 1.0.

The brightness and gamma lookup tables are reloaded from their text files at the time the Start button is pressed. This makes it more convenient to change the luts and see the effect. The files must each contain 256 values separated by carriage return and line feed (CR LF, or the Enter key).

To edit the lookup tables, one can use any text editor such as Notepad, or even Microsoft Excel. For example, the original values might read:

0
1
2
::::::::
254
255

In order to obtain a gain of, for instance, 2×, the operator would modify the table to read:

2
3
4
::::::::
254
255

A library of similar algorithms for the other parameters such as colour temperature, brightness, etc. can be available for a user to perform modifications to them in selected portions of the image.

Aspects of the present invention have been described by way of example only and it should be appreciated that modifications and additions may be made thereto without departing from the scope thereof.

I claim:

1. A display device comprising:

a first display operable to display a first image in a first region of said first display, wherein said first region comprises an area less than the entire area of said first display, and wherein said first display is operable to display a plurality of colors; and a second display operable to dynamically adjust a second region of said second display for modifying said display of said first image in accordance with a parameter, wherein said first and second displays overlap, wherein said second display is operable to display a plurality of colors, wherein a position of said second region of said second display is aligned with a position of said first region of said first display to selectively control an amount of light associated with said first region of said first display by adjusting a plurality of degrees of transmissivity of a plurality of pixels in said second region of said second display, and wherein said second display is further operable to change a value of said parameter.

2. The display device of claim 1, wherein said parameter is selected from a group consisting of a brightness, a contrast, a color, a hue, a color temperature, and a gamma response.

3. The display device of claim 1, wherein said first display is further operable to display a second image in a third region of said first display, wherein said third region comprises an area less than the entire area of said first display, wherein said second display is further operable to adjust a fourth region of said second display for modifying said display of said second image in accordance with a second parameter, wherein said fourth region of said second display corresponds to said third region of said first display, and wherein said parameter and said second parameter are different.

4. The display device of claim 1, wherein said second display is operable to adjust a contrast associated with said first region of said first display while substantially maintaining a net brightness associated with other regions of said first display.

5. The display device of claim 1, wherein each of said first and second displays includes a respective liquid crystal display.

6. The display device of claim 1 further comprising:

a component operable to generate light, and wherein said component operable to generate light is separate from said first display and said second display.

7. The display device of claim 1, wherein said parameter is accessed from a lookup table.

8. A method of controlling a display device, said method comprising:

accessing data operable to display a first image on a first display of said display device, wherein said display device further comprises a second display, wherein said first and second displays overlap, wherein said second display is operable to display a second image, wherein said first and second displays are operable to display a plurality of colors;

determining a parameter associated with a portion of said first image displayed in a first region of said first display, wherein said first region comprises an area less than the entire area of said first display; and dynamically adjusting a second region of said second display to present said portion of said first image in accordance with said parameter, wherein a position of said second region of said second display is aligned with a position of said first region of said first display to selectively control an amount of light associated with said first region of said first display by adjusting a plurality of degrees of transmissivity of a plurality of pixels in said second region of said second display, and wherein said dynamically adjusting further comprises changing a value of said parameter.

9. The method of claim 8, wherein said parameter is selected from a group consisting of a brightness, a contrast, a color, a hue, a color temperature, and a gamma response.

10. The method of claim 8 further comprising:

displaying said first image on said first display.

11. The method of claim 8 further comprising:

accessing a second parameter associated with a third image displayed in a third region of said first display; and adjusting a fourth region of said second display to present said third image in accordance with said second parameter, wherein said first parameter and said second parameter are different.

12. The method of claim 8, wherein said dynamically adjusting further comprises adjusting a contrast of said portion of said first image while substantially maintaining net brightness of other portions of said first image.

13. The method of claim 8, wherein each of said first and second displays includes a respective liquid crystal display.

14. The method of claim 8, wherein said display device further comprises a component operable to generate light, and wherein said component operable to generate light is separate from said first display and said second display.

15. The method of claim 8, wherein said determining a parameter further comprises determining a parameter using a lookup table.

16. A system comprising:

means for accessing data operable to display a first image on a first display of a display device, wherein said display device further comprises a second display, wherein said first and second displays overlap, wherein said first display is operable to display a first image, wherein said second display is operable to display a second image, wherein said first and second displays are operable to display a plurality of colors;

means for determining a parameter associated with a portion of said first image displayed in a first region of said first display, wherein said first region comprises an area less than the entire area of said first display; and means for dynamically adjusting a second region of said second display to present said portion of said first image in accordance with said parameter, wherein a position of said second region of said second display is aligned with a position of said first region of said first display to selectively control an amount of light associated with said first region of said first display by adjusting a plurality of degrees of transmissivity of a plurality of pixels in said second region of said second display, and wherein said means for dynamically adjusting further comprises means for changing a value of said parameter.

17. The system of claim 16, wherein said parameter is selected from a group consisting of a brightness, a contrast, a color, a hue, a color temperature, and a gamma response.

18. The system of claim 16 further comprising:

means for displaying said first image on said first display.

19. The system of claim 16 further comprising:

means for accessing a second parameter associated with a third image displayed in a third region of said first display; and means for adjusting a fourth region of said second display to present said third image in accordance with said second parameter, wherein said parameter and said second parameter are different.

20. The system of claim 16, wherein said means for dynamically adjusting further comprises means for adjusting a contrast of said portion of said first image while substantially maintaining net brightness of other portions of said first image.

21. The system of claim 16, wherein each of said first and second displays includes a respective liquid crystal display.

22. The system of claim 16, wherein said display device further comprises a component operable to generate light, and wherein said component operable to generate light is separate from said first display and said second display.

23. The system of claim 16, wherein said means for determining a parameter further comprises means for determining a parameter using a lookup table.

* * * * *